US011101561B2

(12) United States Patent
Izawa

(10) Patent No.: US 11,101,561 B2
(45) Date of Patent: Aug. 24, 2021

(54) DUAL BAND COMPATIBLE ANTENNA DEVICE

(71) Applicant: Murata Manufacturing Co., Ltd., Kyoto (JP)

(72) Inventor: Masahiro Izawa, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 57 days.

(21) Appl. No.: 16/810,959

(22) Filed: Mar. 6, 2020

(65) Prior Publication Data

US 2020/0212570 A1 Jul. 2, 2020

Related U.S. Application Data

(63) Continuation of application No. PCT/JP2018/028561, filed on Jul. 31, 2018.

(30) Foreign Application Priority Data

Sep. 8, 2017 (JP) ..... JP2017-173244

(51) Int. Cl.
*H01Q 5/321* (2015.01)
*H01Q 1/36* (2006.01)
(Continued)

(52) U.S. Cl.
CPC ..... *H01Q 5/321* (2015.01); *H01Q 1/36* (2013.01); *H01Q 5/371* (2015.01); *H01Q 9/065* (2013.01); *H01Q 9/16* (2013.01)

(58) Field of Classification Search
CPC ..... H01Q 21/30; H01Q 5/371; H01Q 9/44; H01Q 9/16; H01Q 9/065; H01Q 1/36; H01Q 5/321; H01Q 5/335
See application file for complete search history.

(56) References Cited

U.S. PATENT DOCUMENTS 3,454,950 A * 7/1969 Grant ..... H01Q 11/10 343/751
5,872,485 A * 2/1999 Ishikawa ..... H01P 5/087 330/286

(Continued)

FOREIGN PATENT DOCUMENTS

JP 2001-156543 A 6/2001
JP 2003-505962 A 2/2003

(Continued)

OTHER PUBLICATIONS

International Search Report for PCT/JP2018/028561 dated Oct. 9, 2018.
Written Opinion for PCT/JP2018/028561 dated Oct. 9, 2018.

*Primary Examiner* — Graham P Smith
*Assistant Examiner* — Jae K Kim
(74) *Attorney, Agent, or Firm* — Pearne & Gordon LLP

(57) ABSTRACT

A dual band compatible antenna device includes a first branch electrode having a first electrode portion connected to a common electrode with a first adjustment element interposed between the first electrode portion and the common electrode and a second branch electrode having a second electrode portion connected to the common electrode with a second adjustment element interposed between the second electrode portion and the common electrode. The first electrode portion and the second electrode portion are provided on a line to have a length equal to or longer than ⅔ of an electrical length of the first branch electrode and the second branch electrode.

10 Claims, 7 Drawing Sheets

(51) Int. Cl.

| | |
|---|---|
| ***H01Q 9/06*** | (2006.01) |
| ***H01Q 9/16*** | (2006.01) |
| ***H01Q 5/371*** | (2015.01) |

(56) References Cited

U.S. PATENT DOCUMENTS

| | | | | |
|---|---|---|---|---|
| 6,198,442 | B1 * | 3/2001 | Rutkowski | H01Q 1/242 343/702 |
| 8,418,928 | B2 * | 4/2013 | Kato | H01Q 9/26 235/492 |
| 10,403,978 | B2 * | 9/2019 | Zimmerman | H01Q 1/50 |
| 2005/0057430 | A1 * | 3/2005 | Noguchi | H01Q 1/362 343/895 |
| 2007/0285335 | A1 | 12/2007 | Bungo et al. | |
| 2008/0174503 | A1 * | 7/2008 | Kim | H01Q 9/30 343/722 |
| 2011/0248900 | A1 * | 10/2011 | de Rochemont | H01Q 5/15 343/803 |
| 2012/0218162 | A1 * | 8/2012 | Aoki | H01Q 1/242 343/835 |
| 2016/0276733 | A1 * | 9/2016 | Kasahara | H01Q 19/005 |
| 2017/0294715 | A1 * | 10/2017 | Wu | H01Q 9/285 |

FOREIGN PATENT DOCUMENTS

| | | | |
|---|---|---|---|
| JP | 2005-079959 | A | 3/2005 |
| JP | 2010-288175 | A | 12/2010 |
| JP | 2013-207438 | A | 10/2013 |
| WO | 2005-064743 | A1 | 7/2005 |

* cited by examiner

DUAL BAND COMPATIBLE ANTENNA DEVICE

This is a continuation of International Application No. PCT/JP2018/028561 filed on Jul. 31, 2018 which claims priority from Japanese Patent Application No. 2017-173244 filed on Sep. 8, 2017. The contents of these applications are incorporated herein by reference in their entireties.

BACKGROUND

Technical Field

The present disclosure relates to an antenna device used for wireless communications and particularly relates to a dual band compatible antenna device that operates in two frequency bands of low band frequencies and high band frequencies.

As the configuration of a conventional dual band compatible antenna device, for example, the configuration of an antenna device including a branch antenna provided with two radiating elements has been proposed (for example, see Patent Document 1). FIG. 11 is a plan view of the configuration of an antenna device 50 disclosed in Patent Document 1. In the antenna device 50 in Patent Document 1, two radiating elements 52*a* and 52*b* that branch from a feed point 53 are formed on a dielectric substrate 51. The two radiating elements 52*a* and 52*b* are each formed in an electrically conductive pattern shaped in a meandering pattern and are configured to respectively resonate at a low band frequency and a high band frequency. For example, the radiating element 52*a* that is one of the radiating elements is configured to resonate at a low band frequency between 824 MHz and 960 MHz, and the radiating element 52*b* is configured to resonate at a high band frequency between 1710 MHz and 1990 MHz. The two radiating elements 52*a* and 52*b* are connected in series to the feed point 53 connected to an RF circuit of a wireless communication apparatus with lumped electrical elements 54*a* and 54*b* respectively interposed therebetween.

The conventional antenna device illustrated in FIG. 11 has the configuration in which transmission in the frequency bands respectively including the low band frequency and the high band frequency is performed by using the radiating elements 52*a* and 52*b* formed in the meandering pattern and branching from the feed point 53, that is, the configuration in which each element of the radiating elements 52*a* and 52*b* functions as a monopole antenna.

Patent Document 1: Japanese Unexamined Patent Application Publication (Translation of PCT Application) No. 2003-505962

BRIEF SUMMARY

In the conventional antenna device illustrated in FIG. 11 as described above, the two radiating elements 52*a* and 52*b* function as the monopole antenna, and the characteristics of the antenna device are largely influenced by the shape of the substrate and the location of the feed point. In addition, the configuration of the conventional antenna device illustrated in FIG. 11 is the configuration in which the radiating elements 52*a* and 52*b* are caused to function as the monopole antenna and thus leads to a narrow band width.

The present disclosure provides a dual band compatible antenna device that has a high antenna performance in resonant operation at each of the low band frequency and the high band frequency, that is configured to substantially function as a dipole antenna in resonant operation particularly at the high band frequency, that is not largely influenced by the shape of the substrate and the location of the feed point, and that has stable and excellent characteristics enabling a wide band.

A dual band compatible antenna device according to an aspect of the present disclosure includes:

a common electrode connected to a feed point at an end of the common electrode, supplied with a signal at a low band frequency and a signal at a high band frequency from the feed point, and having a branching portion formed at a different end of the common electrode;

a first adjustment element connected to an end of the branching portion;

a second adjustment element connected to a different end of the branching portion, the different end being opposite the end of the branching portion;

a first branch electrode having a first electrode portion connected to the common electrode with the first adjustment element interposed between the first electrode portion and the common electrode; and a second branch electrode having a second electrode portion connected to the common electrode with the second adjustment element interposed between the second electrode portion and the common electrode.

The first electrode portion and the second electrode portion are provided on a line to have a length equal to or longer than ⅔ of an electrical length of the second branch electrode and the first branch electrode.

The dual band compatible antenna device is configured such that when the signal at the low band frequency is supplied from the feed point to the common electrode, current flowing through the first electrode portion via the first adjustment element is more than current flowing through the second electrode portion via the second adjustment element.

The dual band compatible antenna device is configured such that when the signal at the high band frequency is supplied from the feed point to the common electrode, the first adjustment element functions as inductive reactance, the second adjustment element functions as capacitive reactance, the current flowing through the first electrode portion via the first adjustment element and the current flowing through the second electrode portion via the second adjustment element have identical phases, and the signal at the high band frequency causes the first branch electrode and the second branch electrode to resonate as a dipole antenna.

According to the present disclosure, it is possible to provide the dual band compatible antenna device that has a high antenna performance in resonant operation at each of the low band frequency and the high band frequency and possible to provide the dual band compatible antenna device that is not largely influenced by the shape of the substrate and the location of the feed point in the resonant operation particularly at the high band frequency and that has stable and excellent characteristics enabling a wide band.

DETAILED DESCRIPTION

Figure 1:
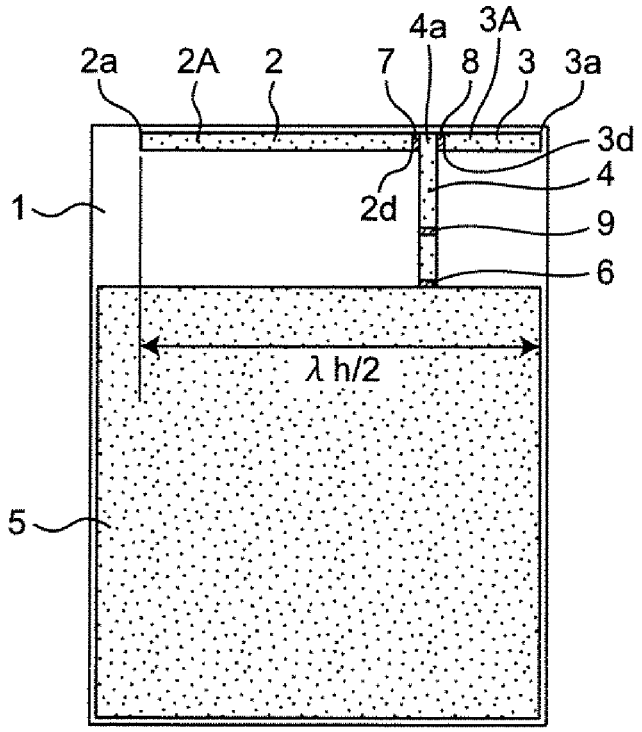
FIG. 1 is a plan view illustrating the configuration of a dual band compatible antenna device according to Embodiment 1 of the present disclosure.

First of all, the configuration of a dual band compatible antenna device according to each of various aspects of the present disclosure will be described.

A dual band compatible antenna device in a first aspect according to the present disclosure includes:

a common electrode connected to a feed point at an end of the common electrode, supplied with a signal at a low band frequency and a signal at a high band frequency from the feed point, and having a branching portion formed at a different end of the common electrode;

a first adjustment element connected to an end of the branching portion;

a second adjustment element connected to a different end of the branching portion, the different end being opposite the end of the branching portion;

a first branch electrode having a first electrode portion connected to the common electrode with the first adjustment element interposed between the first electrode portion and the common electrode; and a second branch electrode having a second electrode portion connected to the common electrode with the second adjustment element interposed between the second electrode portion and the common electrode.

The first electrode portion and the second electrode portion are provided on a line to have a length equal to or longer than ⅔ of an electrical length of the second branch electrode and the first branch electrode.

The dual band compatible antenna device is configured such that when the signal at the low band frequency is supplied from the feed point to the common electrode, current flowing through the first electrode portion via the first adjustment element is more than current flowing through the second electrode portion via the second adjustment element.

The dual band compatible antenna device is configured such that when the signal at the high band frequency is supplied from the feed point to the common electrode, the first adjustment element functions as inductive reactance, the second adjustment element functions as capacitive reactance, the current flowing through the first electrode portion via the first adjustment element and the current flowing through the second electrode portion via the second adjustment element have identical phases, and the signal at the high band frequency causes the first branch electrode and the second branch electrode to resonate as a dipole antenna.

According to the dual band compatible antenna device configured as described above in the first aspect, a dual band compatible antenna device that has a high antenna performance in resonant operation at each of the low band frequency and the high band frequency can be provided, is not largely influenced by the shape of the substrate and the location of the feed point in the resonant operation particularly at the high band frequency, and has stable and excellent characteristics enabling a wide band.

In the first aspect, in the dual band compatible antenna device in a second aspect according to the present disclosure, an electrical length from a distal end of the first branch electrode to a distal end of the second branch electrode may be a length that is about ½ of a wave length of the high band frequency, the distal end of the first branch electrode being opposite a proximal end on a branching portion side of the first branch electrode, the distal end of the second branch electrode being opposite the proximal end on a branching portion side of the second branch electrode.

In the first or second aspect, in the dual band compatible antenna device in a third aspect according to the present disclosure, the common electrode may be provided with a third adjustment element.

In the third aspect, in the dual band compatible antenna device in the fourth aspect according to the present disclosure, the third adjustment element may be formed from inductive reactance, the capacitive reactance, or combination of the inductive reactance with the capacitive reactance.

In any one of the first to fourth aspects, the dual band compatible antenna device in the fifth aspect according to the present disclosure may be configured such that when the signal at the low band frequency is supplied from the feed point to the common electrode, the first adjustment element functions as the inductive reactance, and the signal at the low band frequency causes the common electrode and the first branch electrode to resonate as a monopole antenna.

Hereinafter, a dual band compatible antenna device according to the present disclosure will be described by using a plurality of embodiments illustrating various configurations with reference to the drawings. Note that in the dual band compatible antenna device described below, the configuration of an antenna device operating at frequencies in 2 GHz to 3 GHz band (shortened as a 2 GHz band)/5 GHz to 6 GHz band (shortened as a 5 GHz band) respectively serving as resonant frequencies in the low band and high band is described; however, the frequency bands of the present disclosure are not limited to these frequency bands.

Embodiment 1

FIG. 1 is a plan view illustrating the configuration of a dual band compatible antenna device according to Embodiment 1 of the present disclosure. As illustrated in FIG. 1, the dual band compatible antenna device of Embodiment 1 has a configuration in which electrode patterns (2, 3, 4, and 5) are formed on a substrate 1 that is a rectangular plate substrate formed from a dielectric material and the like and in which a feed point (node) 6 and various adjustment elements (7, 8, and 9) are provided.

In the dual band compatible antenna device of Embodiment 1, one end of the feed point 6 for the low band frequency/high band frequency for the electrode patterns is electrically connected to a rectangular ground electrode (GND) 5 formed in such a manner as to cover a half or larger area of the surface of the substrate 1. In contrast, the other end of the feed point 6 is electrically connected to a linearly extending common electrode 4. Note that in this specification, electrical connection includes not only a configuration of connection in direct contact but also a configuration of connection performed with an electrical element such as for capacitive reactance or inductive reactance interposed between two components.

One end of a branching portion 4*a* (an upper end in FIG. 1) that is a derivation end portion on the antenna side in the common electrode 4 is electrically connected to a first branch electrode 2 with a first adjustment element 7 (e.g., a circuit element) interposed therebetween. The other end of the branching portion 4*a* of the common electrode 4 is electrically connected to a second branch electrode 3 with a second adjustment element 8 (e.g., a circuit element) interposed therebetween. Specifically, one end of the branching portion 4*a* of the common electrode 4 is connected in series to the first branch electrode 2 with the first adjustment element 7 interposed therebetween, and the other end of the branching portion 4*a* is connected in series to the second branch electrode 3 with the second adjustment element 8 interposed therebetween.

As illustrated in FIG. 1, the first branch electrode 2 and the second branch electrode 3 are each formed linearly and are provided on a line. In the configuration of Embodiment 1, as illustrated in FIG. 1, the common electrode 4 extends linearly, and the first branch electrode 2 and the second branch electrode 3 are provided on a line, which are formed in such a manner as to shape a "T" letter. In addition, the extending direction of the first branch electrode 2 and the second branch electrode 3 that are provided on a line is substantially parallel to an edge portion of the ground electrode 5, the edge portion facing the first branch electrode 2 and the second branch electrode 3. The first branch electrode 2 and the second branch electrode 3 have a constant distance to the ground electrode 5 facing the first branch electrode 2 and the second branch electrode 3.

In the electrode patterns configured as described above, inductive reactance (an inductor chip) having inductance is used for the first adjustment element 7 connecting the common electrode 4 and the first branch electrode 2. In contrast, for the second adjustment element 8 connecting the common electrode 4 and the second branch electrode 3, capacitive reactance (a capacitor chip) having capacitance is used. Note that using, as the first adjustment element 7 and the second adjustment element 8 that are used in the present disclosure, devices respectively functioning as the inductive reactance and the capacitive reactance in the high frequency band leads to the configuration in which the first branch electrode 2 and the second branch electrode 3 function as the dipole antenna in the high frequency band as to be described later.

Note that in the configuration of the dual band compatible antenna device of Embodiment 1, in addition to the first adjustment element 7 between the common electrode 4 and the first branch electrode 2 and the second adjustment element 8 between the common electrode 4 and the second branch electrode 3, a third adjustment element 9 may be provided in the intermediate portion of the common electrode 4. The third adjustment element 9 has a function of compensating the matching and adjustment performed by the first adjustment element 7 and the second adjustment element 8 and enables finer adjustment operation in the resonant operation of the dual band compatible antenna device of Embodiment 1.

To cause the dual band compatible antenna device of Embodiment 1 to function as the dipole antenna in the resonant operation at the high band frequency, the dual band compatible antenna device is configured as described above, and the electrical length of all of the branch electrodes from a distal end 2*a* (derivation end portion) of the first branch electrode 2 to a distal end 3*a* (derivation end portion) of the second branch electrode 3 is set to be about ½ of the wave length (λh) of a high band resonant frequency (fh) (see FIG. 1).

Note that to resonate at a specific low band frequency (fl) for functioning as the monopole antenna, the electrical length, of the first branch electrode 2, in the extending direction (right and left directions in FIG. 1) is set to be a desired length, the first adjustment element 7 is set, and the third adjustment element 9 is set, if necessary.

The first adjustment element 7 functioning as the inductive reactance is provided between the common electrode 4 and the first branch electrode 2 in the dual band compatible antenna device of Embodiment 1 configured as described above, and thus the phase of current flowing through the first branch electrode 2 is 90° ahead of the feed voltage. In contrast, the second adjustment element 8 functioning as the capacitive reactance is provided between the common electrode 4 and the second branch electrode 3, and thus the phase of current flowing through the second branch electrode 3 is 90° behind the feed voltage. In addition, the first branch electrode 2 and the second branch electrode 3 are disposed in mutually opposite directions from the branching portion 4*a* of the common electrode 4 and extend linearly. Accordingly, when a signal at a high band frequency is fed from the common electrode 4 in the dual band compatible antenna device of Embodiment 1, current in the same phase consequently flows through the first branch electrode 2 and the second branch electrode 3, and the first branch electrode 2 and the second branch electrode 3 function as the dipole antenna (an asymmetrical dipole antenna).

The dual band compatible antenna device of Embodiment 1 as described above has the following configuration. When a signal at a high band frequency is supplied from the feed point 6 to the common electrode 4, the current in the same phase flows through a first electrode portion 2A and a second electrode portion 3A that extend linearly and that are respectively an entire portion of the first branch electrode 2 and an entire portion of the second branch electrode 3, and the first electrode portion 2A and the second electrode portion 3A function as the main bodies of the radiators of the antenna device.

In the dual band compatible antenna device of Embodiment 1, the flowing of the current in the same phase through the first electrode portion 2A and the second electrode portion 3A can be verified by performing measurement, for example, in the following manner.

In the resonance band of the high band frequencies, a current phase difference is measured with an oscilloscope simultaneously at a proximal end 2*d* on the first adjustment element 7 side in the first electrode portion 2A and at a proximal end 3*d* on the second adjustment element 8 side in the second electrode portion 3A. At this time, if there is no phase difference between the current flowing through the proximal end 2*d* on the first adjustment element 7 side in the first electrode portion 2A and the current flowing through the proximal end 3*d* on the second adjustment element 8 side in the second electrode portion 3A, it can be verified that the currents respectively flowing through the first electrode portion 2A and the second electrode portion 3A have the same phase.

Figure 2:
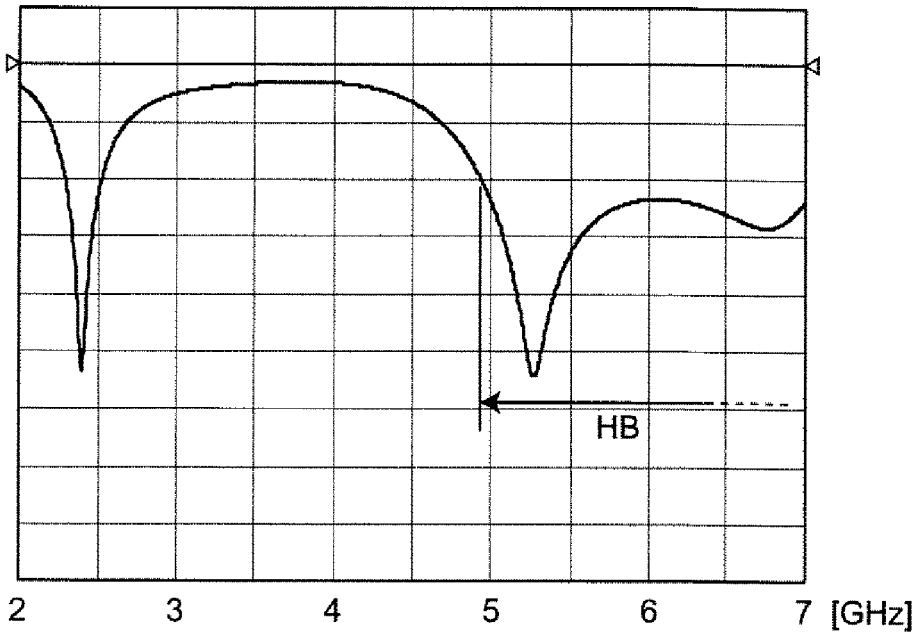
FIG. 2 is a frequency characteristic graph illustrating the results of simulation experiments performed on the dual band compatible antenna device of Embodiment 1.

FIG. 2 is a frequency characteristic graph illustrating the results of simulation experiments performed on the dual band compatible antenna device of Embodiment 1 configured as described above. In the frequency characteristic graph in FIG. 2, the vertical axis represents return-loss, and the horizontal axis represents frequency. In these simulation experiments, the frequency band is from 2.0 GHz to 7.0 GHz. As illustrated in the frequency characteristic graph in FIG. 2, there are low return-losses in the two frequency bands of the low band frequencies (2 GHz band) and the high band frequencies (5 GHz band). In particular, when a signal at a high band frequency for functioning as the dipole antenna is fed, highly efficient radiating operation is performed in a wide band.

Figure 3A:
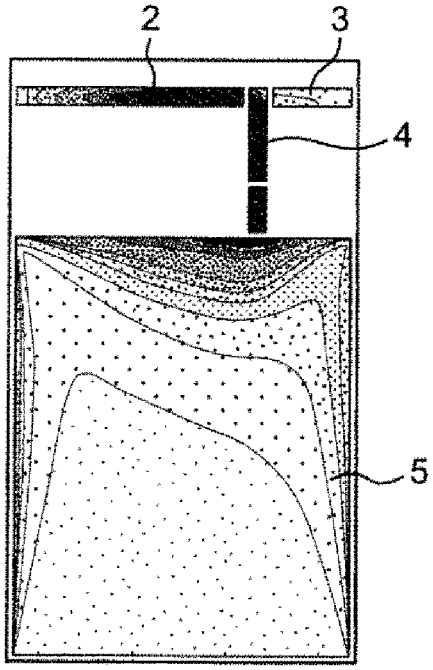
FIGS. 3A and 3B represent contour charts illustrating current density in electrode patterns in the simulation experiments performed on the dual band compatible antenna device of Embodiment 1.
Figure 3B:
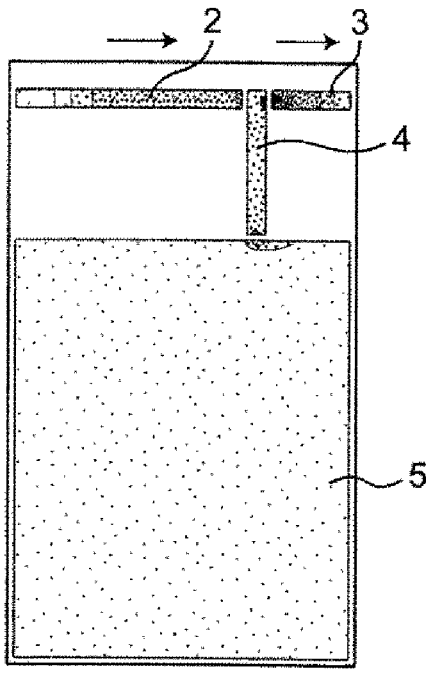

FIGS. 3A and 3B represent contour charts illustrating current density in the electrode patterns in the simulation experiments performed on the dual band compatible antenna device of Embodiment 1. FIG. 3A is a contour chart illustrating current density at the time when a signal at a low band frequency (2 GHz band) is fed in the dual band compatible antenna device of Embodiment 1. FIG. 3B is a contour chart illustrating current density at the time when a signal at a high band frequency (5 GHz band) is fed. In the contour chart illustrated in FIGS. 3A and 3B, areas of a color contour chart representing the magnitude of the density of current flowing through the electrode patterns are shaded by using black and white point density and represent that an area having higher point density has higher current density and that the current flows therethrough.

As illustrated in FIG. 3A, it is represented that when a signal at a low band frequency (2 GHz band) is fed, the current flows through not only the first branch electrode 2 and the common electrode 4 but also the ground electrode 5. That is, when a signal at a low band frequency (2 GHz band) is fed in the configuration of the dual band compatible antenna device of Embodiment 1, the first branch electrode 2 functions as the monopole antenna.

In contrast, as illustrated in FIG. 3B, it is represented that when a signal at a high band frequency (5 GHz band) is fed, the current almost does not flow through the ground electrode 5 and the first branch electrode 2 but flows through the second branch electrode 3 and the common electrode 4. That is, in the configuration of the dual band compatible antenna device of Embodiment 1, the first branch electrode 2 and the second branch electrode 3 substantially function as the dipole antenna. Accordingly, the dual band compatible antenna device of Embodiment 1 is not influenced by the shape of the substrate and the location of the feed point and is configured to enable a wide band in the high frequency band.

Comparative Example

Figure 4:
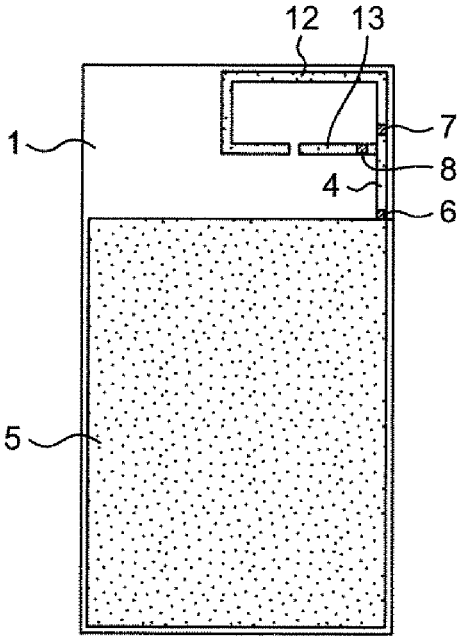
FIG. 4 is a plan view illustrating the configuration of electrode patterns in a comparative example in which the simulation experiments are performed.

As a comparative example for the configuration of the dual band compatible antenna device of Embodiment 1, the inventors perform simulation experiments by using the configuration of the electrode patterns illustrated in in FIG. 4. The configuration in the comparative example is a configuration in which when a signal in any of the frequency bands of low band frequencies (2 GHz band) and high band frequencies (5 GHz band) is fed, the electrode patterns function as the monopole antenna. In the configuration in the comparative example having the electrode patterns illustrated in FIG. 4, the branching portion of the common electrode 4 connected to the feed point 6 branches to substantially make a right angle and is electrically connected to a first branch electrode 12 and a second branch electrode 13. The first branch electrode 12 extending from the branching portion of the common electrode 4 with the first adjustment element 7 interposed therebetween has a shape in which a linear electrode pattern is bent a plurality of times. As illustrated in FIG. 4, the electrode pattern serving as the main body of the first branch electrode 12 is a linear electrode pattern composed of three sides of four sides constituting a rectangle and part of the remaining side. In contrast, the second branch electrode 13 is a linear electrode pattern, and as illustrated in FIG. 4, the first branch electrode 12 and the second branch electrode 13 substantially form four sides of a rectangle. Note that the ground electrode 5 is formed in such a manner as to cover a half or larger area of the surface of the substrate 1, and the feed point 6 is disposed between the ground electrode 5 and the common electrode 4.

Figure 5:
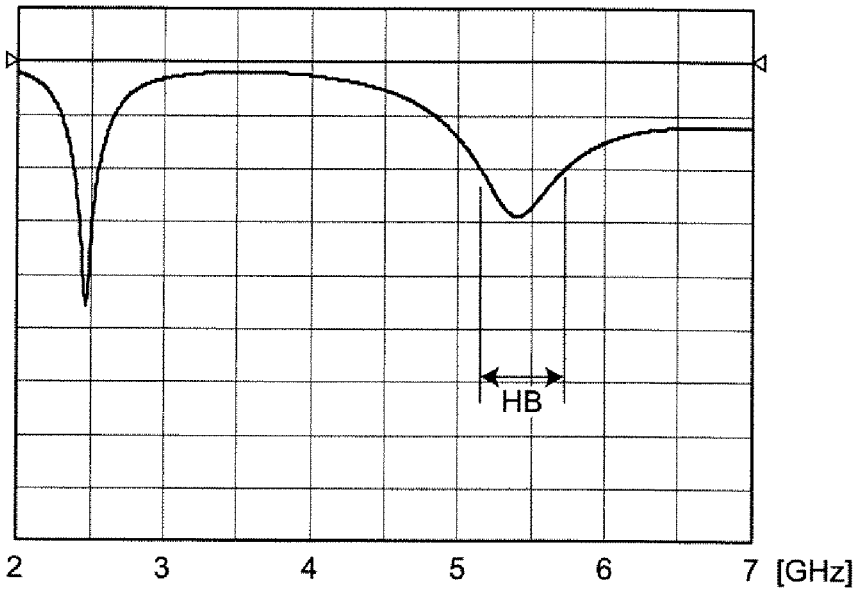
FIG. 5 is a frequency characteristic graph illustrating the results of simulation experiments performed in the configuration in the comparative example.

In the comparative example configured as described above, the same experiments as the simulation experiments performed on the dual band compatible antenna device of Embodiment 1 (frequency band: 2.0 GHz to 7.0 GHz) are performed. FIG. 5 is a frequency characteristic graph illustrating the results of the simulation experiments performed on the configuration in the comparative example. In the frequency characteristic graph in FIG. 5, the vertical axis represents return-loss, and the horizontal axis represents frequency. As illustrated in the frequency characteristic graph in FIG. 5, resonance occurs in the two frequency bands that are the low frequency band (2 GHz band) and the high frequency band (5 GHz band), but the resonance band is narrow in the frequency band (5 GHz band) of the high band frequencies. For example, a high frequency band (HB) having return-losses equal to or lower than −10 dB in the high frequency band (5 GHz band) ranges from about 5.1 GHz to about 5.5 GHz in the frequency characteristic graph in FIG. 5, and the span is about 0.4 GHz. In contrast, in the dual band compatible antenna device of Embodiment 1, as illustrated in the frequency characteristic graph in FIG. 2, the range of the high frequency band (HB) having return-losses equal to or lower than −10 dB is equal to or higher than about 4.9 GHz to 6.0 GHz. Accordingly, the configuration of the dual band compatible antenna device of Embodiment 1 has a wide high frequency band (HB).

[Modifications]

Figure 6:
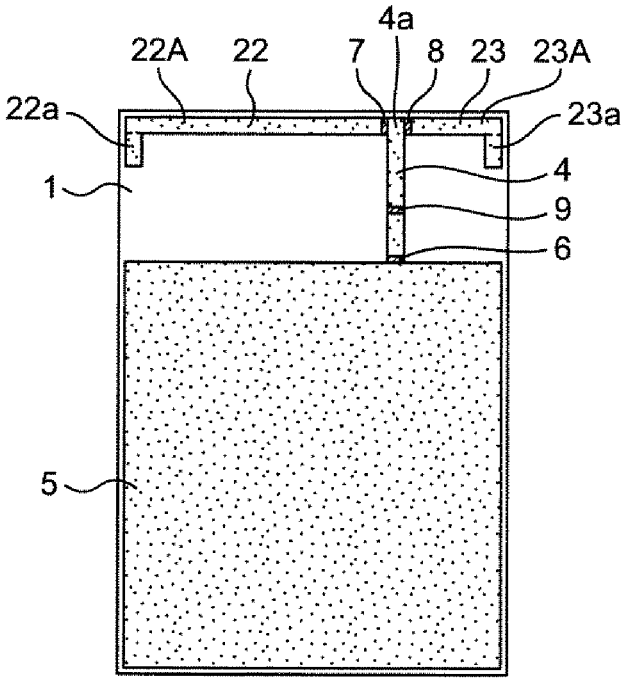
FIG. 6 is a plan view illustrating a modification of the dual band compatible antenna device of Embodiment 1 illustrated in FIG. 1.

FIG. 6 is a plan view illustrating a modification of the dual band compatible antenna device of Embodiment 1 illustrated in FIG. 1. The modification illustrated in FIG. 6 has a configuration in which derivation end portions (22*a* and 23*a*) in a first branch electrode 22 and a second branch electrode 23, respectively, are bent at a right angle. However, also in the modification illustrated in FIG. 6, in the first branch electrode 22 and the second branch electrode 23, radiators serving as the respective main bodies at the time of feeding a signal at a high band frequency are a first electrode portion 22A and a second electrode portion 23A that derive in mutually opposite directions on the same line from the branching portion 4*a* of the common electrode 4 with the adjustment elements (7 and 8) interposed therebetween. In the modification illustrated in FIG. 6, the first branch electrode 22 has the first electrode portion 22A and a first derivation end portion 22*a*. In contrast, the second branch electrode 23 has the second electrode portion 23A and a second derivation end portion 23*a*.

The first derivation end portion 22*a* and the second derivation end portion 23*a* respectively defined by the bending locations in the first branch electrode 22 and the second branch electrode 23, each has a length shorter than ⅓ of the electrical length of a corresponding one of the branch electrodes (22 and 23). That is, each of the first electrode portion 22A in the first branch electrode 22 and the second electrode portion 23A in a second electrode 23 that are derivation portions extending from the branching portion 4*a* is provided on a line in such a manner the electrical length thereof accounts for ⅔ or more. In addition, the electrical length of all of the branch electrodes that are the first branch electrode 22 and the second branch electrode 23 is about ½ of the wave length (λh) of the high band frequency (fh).

Figure 7:
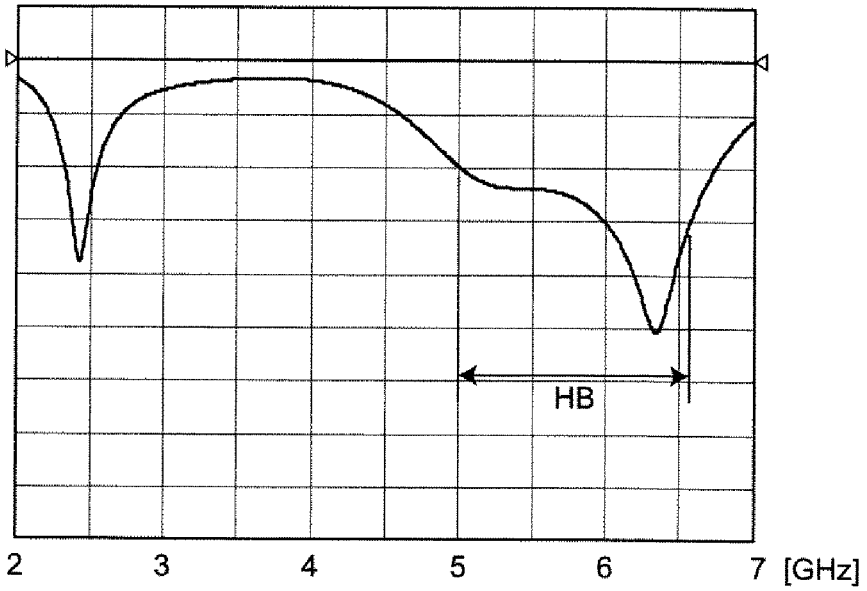
FIG. 7 is a frequency characteristic graph illustrating the results of simulation experiments performed in the modification.

The same experiments (frequency band: 2.0 GHz to 7 GHz) as the simulation experiments performed on the dual band compatible antenna device of Embodiment 1 are performed in the modification configured as described above. FIG. 7 is a frequency characteristic graph illustrating the results of the simulation experiments performed in the modification illustrated in FIG. 6. In the frequency characteristic graph in FIG. 7, the vertical axis represents return-loss, and the horizontal axis represents frequency. As illustrated in the frequency characteristic graph in FIG. 7, resonance occurs in the two frequency bands of the low band frequencies (2 GHz band) and the high band frequencies (5 GHz band). In particular, the resonance band of the frequency band (5 GHz band) of the high band frequencies is wide. In the frequency characteristic graph in FIG. 7, for example, the high frequency band (HB) having return-losses equal to or lower than −10 dB ranges from about 5.0 GHz to about 6.7 GHz. Accordingly, the dual band compatible antenna device in this modification also has the configuration having a wide high frequency band (HB).

Figure 8:
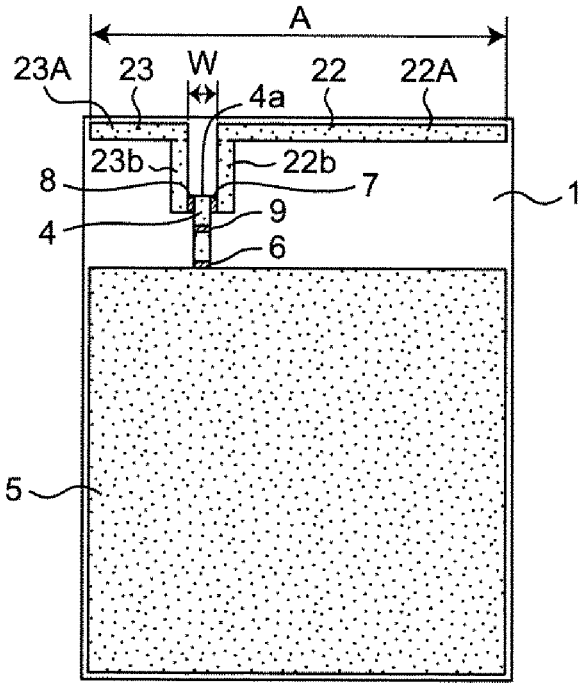
FIG. 8 is a plan view illustrating a modification of the dual band compatible antenna device of Embodiment 1.

FIG. 8 is a plan view illustrating another modification of the dual band compatible antenna device of Embodiment 1 illustrated in FIG. 1. The modification illustrated in FIG. 8 has a configuration in which derivation base portions (a first derivation base portion 22*b* and a second derivation base portion 23*b*) in the first branch electrode 22 and the second branch electrode 23, respectively, are bent at a right angle. The modification illustrated in FIG. 8 has a configuration in which the first derivation base portion 22*b* and the second derivation base portion 23*b* derive from the branching portion 4*a* of the common electrode 4 in parallel in the same direction in such a manner as to move away from the ground electrode 5 with the adjustment elements (7 and 8) interposed therebetween (derive upwards in FIG. 8). The first derivation base portion 22*b* and the second derivation base portion 23*b* are provided close to each other and extend in parallel in the same direction, and a distance (W) between the first derivation base portion 22*b* and the second derivation base portion 23*b* is set to be a predetermined distance. The distance (W) between the first derivation base portion 22*b* and the second derivation base portion 23*b* is set equal to or shorter than ⅓ of a total length (A) of the first branch electrode 22 and the second branch electrode 23. In addition, the first derivation base portion 22*b* and the second derivation base portion 23*b*, each has a length, in the extending direction, shorter than ⅓ of the electrical length of a corresponding one of the branch electrodes (22 and 23).

Accordingly, in the configuration of the modification illustrated in FIG. 8, the main bodies of the radiators at the time when a signal at a high band frequency is fed in the first branch electrode 22 and the second branch electrode 23 are the first electrode portion 22A and the second electrode portion 23A that derive from the end portions of the first derivation base portion 22*b* and the second derivation base portion 23*b*, respectively, in mutually opposite directions on the same line. The configuration of the first branch electrode 22 and the second branch electrode 23 as described above leads to the following. When a signal at a high band frequency is fed from the common electrode 4 to the first branch electrode 22 and the second branch electrode 23, current in the same phase consequently flows through the first electrode portion 22A of the first branch electrode 22 and the second electrode portion 23A of the second branch electrode 23 in the same manner as in the configuration of the other embodiment, and the first branch electrode 22 and the second branch electrode 23 function as the dipole antenna (asymmetrical dipole antenna).

The dual band compatible antenna device in FIG. 8 configured as described above has a configuration in which damage to and disconnection of the adjustment elements (7 and 8) due to a shock or the like at the time of handling the substrate 1 are prevented because the adjustment elements (7 and 8) are not provided near the edge of the substrate 1. The dual band compatible antenna device in FIG. 8 has the following configuration. The first derivation base portion 22*b* and the second derivation base portion 23*b* have a distance (W) therebetween that is set equal to or shorter than ⅓ of the total length (A) in the arrangement positions of the first electrode portion 22A of the first branch electrode 22 and the second electrode portion 23A of the second branch electrode 23 and are thus provided close to each other. Accordingly, communication characteristics are not deteriorated, and the adjustment elements (7 and 8) can be provided in such a manner as to be far away from the edge side of the substrate 1.

As described above, configuring the dual band compatible antenna device of Embodiment 1 as follows can achieve the configuration in which when a signal at a high band frequency is fed, the first branch electrode 2 or 22 and the second branch electrode 3 or 23 function as the dipole antenna.

(1) The dual band compatible antenna device includes the first branch electrode 2 or 22 and the second branch electrode 3 or 23 that respectively include the first electrode portion 2A or 22A and the second electrode portion 3A or 23A that derive in mutually opposite directions from the branching portion 4*a* of the common electrode 4 with the adjustment elements 7 and 8 interposed therebetween. The first electrode portion 2A or 22A and the second electrode portion 3A or 23A serve as the main bodies of the radiators of the first branch electrode 2 or 22 and the second branch electrode 3 or 23 when a signal at a high band frequency is fed and are provided substantially on a line.

(2) The dual band compatible antenna device is configured such that the first adjustment element 7 or the second adjustment element 8 each of which is connected to the branching portion 4*a* that is the derivation end portion of the common electrode 4 causes one of the phases of current to be 90° ahead of the feed voltage and the other to be 90° behind, the current flowing through the first electrode portion 2A or 22A of the first branch electrode 2 or 22 and the second electrode portion 3A or 23A of the second branch electrode 3 or 23, the first electrode portion 2A or 22A and the second electrode portion 3A or 23A deriving in mutually opposite directions. The current is thereby caused to flow through the first branch electrode 2 or 22 and the second branch electrode 3 or 23 in substantially the same direction, and consequently the current in the same phase is caused to flow through the two branch electrodes.

(3) The electrical length of all of the branch electrodes from the distal end, of the first branch electrode 2 or 22, in the derivation direction to the distal end, of the second branch electrode 3 or 23, in the derivation direction is about ½ of the wave length (λh) of the high band frequency (fh).

Accordingly, the dual band compatible antenna device of Embodiment 1 according to the present disclosure is the dual band compatible antenna device that has a high antenna performance in resonant operation at each of a low band frequency and a high band frequency, that is configured to function as the dipole antenna in the resonant operation particularly at the high band frequency, that is not largely influenced by the shape of the substrate and the location of the feed point relative to the antenna pattern, and that has stable and excellent characteristics enabling a wide band.

Embodiment 2

Figure 9:
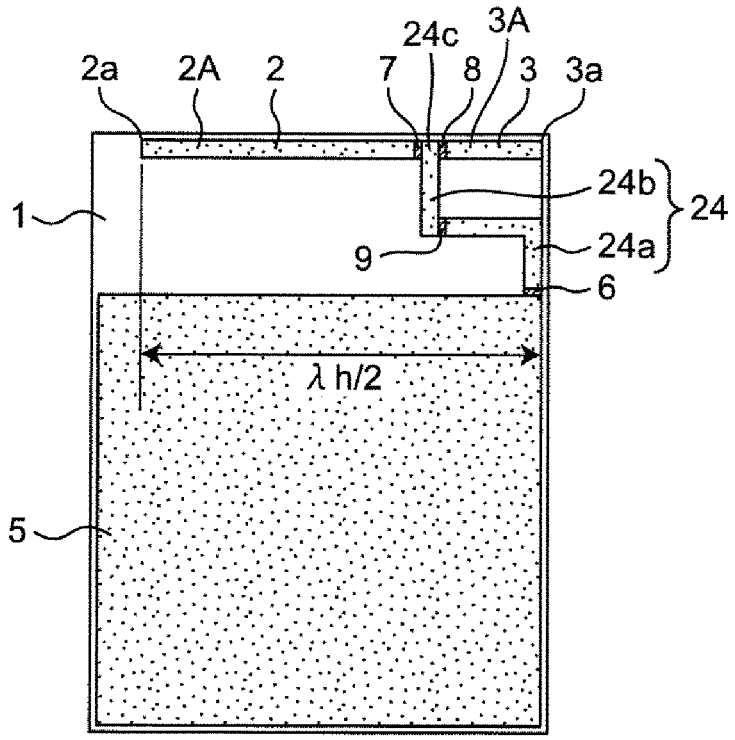
FIG. 9 is a plan view illustrating the configuration of a dual band compatible antenna device according to Embodiment 2 of the present disclosure.

FIG. 9 is a plan view illustrating the configuration of a dual band compatible antenna device according to Embodiment 2 of the present disclosure. As illustrated in FIG. 9, a large difference of the configuration of the dual band compatible antenna device of Embodiment 2 from the above-described configuration of Embodiment 1 lies in the shape and the arrangement of a common electrode 24 for electrical connection from the feed point 6 to the first branch electrode 2 and the second branch electrode 3. Note that in the description for Embodiment 2, components having the same function, configuration, and operation as those of the components described for Embodiment 1 are denoted by the same reference numerals, and description thereof might be omitted.

The common electrode 24 in the configuration of the dual band compatible antenna device according to Embodiment 2 has a bent shape as illustrated in FIG. 9 and has a longer line length than that of the linear common electrode 4 in the configuration of Embodiment 1. In addition, the feed point 6 to which the common electrode 24 is electrically connected and a signal at a low band frequency/high band frequency is supplied is connected to a portion near an end portion of a side, of the rectangular ground electrode 5, facing the branch electrodes (2 and 3), that is, a corner of the ground electrode 5.

The common electrode 24 is a bent and linear electrode pattern provided for electrical connection from the feed point 6 to a portion connecting the first branch electrode 2 and the second branch electrode 3 (branching portion). The third adjustment element 9 is disposed in the intermediate portion of the common electrode 24. Accordingly, the common electrode 24 includes a first common electrode 24*a* and a second common electrode 24*b*, the first common electrode 24*a* being bent in an L letter shape and connecting the feed point 6 and the third adjustment element 9, the second common electrode 24*b* extending linearly from the third adjustment element 9 to a branching portion 24*c*.

The first adjustment element 7, the second adjustment element 8, and the third adjustment element 9 provided for the electrode patterns are appropriately set to take on respective desired values in consideration of the used bands of the low band frequencies/high band frequencies, the shapes of electrode patterns, and the like. Note that in the configuration, when a signal at a low band frequency/high band frequency is fed, the first adjustment element 7 functions as the inductive reactance, and the second adjustment element 8 functions as the capacitive reactance. It suffices that in the configuration, particularly when a signal at a high band frequency is fed, the first adjustment element 7 functions as the inductive reactance, and the second adjustment element 8 functions as the capacitive reactance.

Note that the dual band compatible antenna device of Embodiment 2 is configured such that when a signal at a high band frequency is supplied from the feed point 6 to the common electrode 24 (24*a* and 24*b*), the first electrode portion 2A that is an entire portion of the first branch electrode 2 extending linearly and the second electrode portion 3A that is an entire portion of the second branch electrode 3 function as the main bodies of the radiators in the antenna device.

In a case such as the case where the common electrode 24 has the longer line length than that in the above-described configuration of Embodiment 1 as described above, an element including capacitive reactance needs to be provided as the first adjustment element 7; however, providing an element having capacitive reactance to the third adjustment element 9 eliminates the need for providing the element including capacitive reactance to the first adjustment element 7 and enables a configuration in which the first adjustment element 7 only has a function as the inductive reactance. As the result of this, the dual band compatible antenna device according to Embodiment 2 is configured such that the feeding of a signal at a high band frequency causes a state where the current in substantially the same phase flows through the first electrode portion 2A of the first branch electrode 2 and the second electrode portion 3A of the second branch electrode 3 and such that the dual band compatible antenna device functions as the dipole antenna.

The inventors perform simulation experiments in the configuration of the dual band compatible antenna device of Embodiment 2. A configuration including the third adjustment element 9 is compared with a configuration without necessarily the third adjustment element 9. In these simulation experiments, the frequency band is 2.0 GHz to 7.0 GHz like the simulation experiments in Embodiment 1 described above.

Figure 10A:
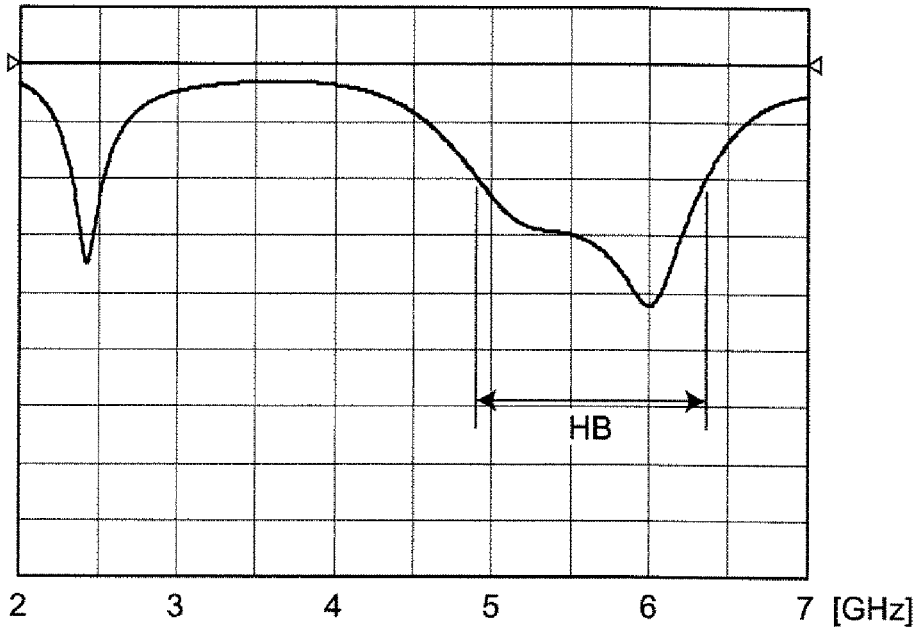
FIGS. 10A and 10B are frequency characteristic graphs illustrating results in respective cases where a third adjustment element is provided in the configuration of Embodiment 2 and where the third adjustment element is not provided.
Figure 10B:
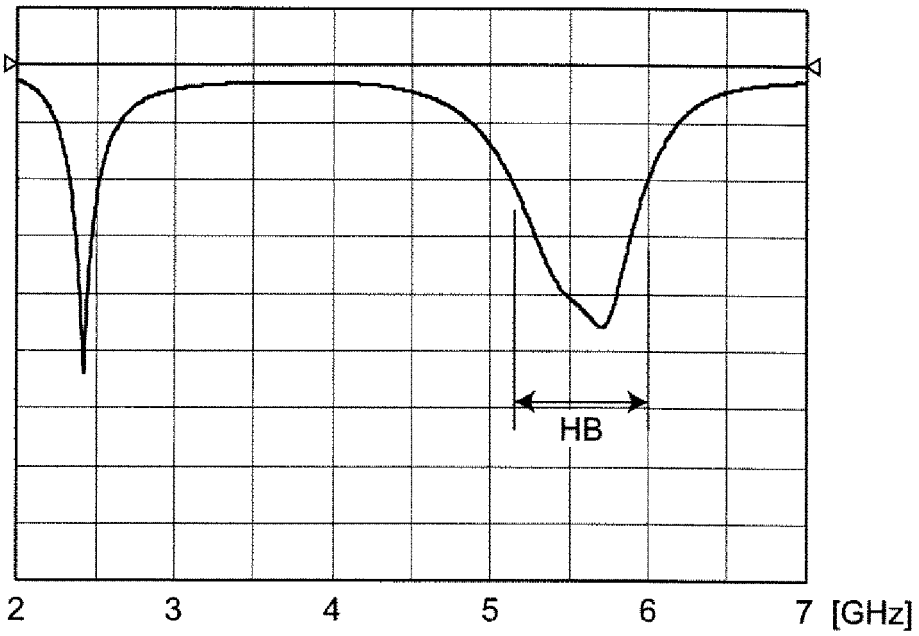
Figure 11:
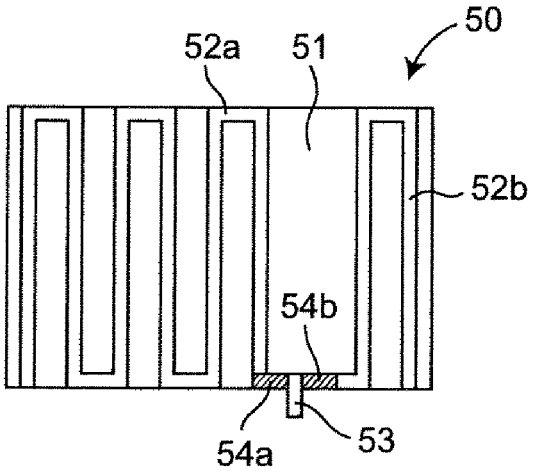
FIG. 11 is a plan view illustrating the configuration of a conventional antenna device.

In FIG. 10A represents a frequency characteristic graph illustrating results in the case where the third adjustment element 9 is provided, and FIG. 10B represents a frequency characteristic graph illustrating results in the case where the third adjustment element 9 is not provided. The frequency characteristic graph illustrated in FIG. 10A represents a configuration in which in the band of the high band frequencies for functioning as the dipole antenna, operation is performed in a wider band than that in the frequency characteristic graph illustrated in in FIG. 10B. In the frequency characteristic graph illustrated in FIG. 10A in the case where the third adjustment element 9 is provided, for example, the high frequency band (HB) having return-losses equal to or lower than −10 dB ranges from about 4.9 GHz to about 6.3 GHz. In contrast, in the frequency characteristic graph illustrated in FIG. 10B in the case where the third adjustment element 9 is not provided, for example, the high frequency band (HB) having return-losses equal to or lower than −10 dB ranges from about 5.2 GHz to about 6.0 GHz. As described above, the third adjustment element 9 is provided for matching. When a signal at a high band frequency is fed, the first adjustment element 7 is caused to function as the inductive reactance, and the second adjustment element 8 is caused to function as the capacitive reactance. The configuration in which the first branch electrode 2 and the second branch electrode 3 function as the dipole antenna is thereby achieved. Accordingly, also in the configuration of the dual band compatible antenna device of Embodiment 2, the configuration reliably having a wide high frequency band (HB).

In the dual band compatible antenna device of Embodiment 2 according to the present disclosure, for example, even in a case of a long line length from the feed point 6 to the branch electrodes (2 and 3), or in various shapes of electrode patterns, an element having a desired function is set as the third adjustment element 9. When a signal at a high band frequency is fed, it is thereby possible to cause the first adjustment element 7 and the second adjustment element 8 to respectively function as the inductive reactance and the capacitive reactance reliably. The configuration in which the dual band compatible antenna device is caused to function as the dipole antenna in the band of the high band frequencies and reliably operate in a wide band is achieved.

As described above, the dual band compatible antenna device of the present disclosure is the dual band compatible antenna device that has a high antenna performance in resonant operations at each of the low band frequency and the high band frequency, that is configured to function as the dipole antenna in the resonant operation particularly at the high band frequency, and that has stable and excellent characteristics for a wide band without necessarily being influenced by the shape of the substrate and the location of the feed point relative to the antenna pattern.

The present disclosure has been described in detail to some degree by using embodiments; however, the configurations are illustrative, and the content of the disclosure of the embodiments should be changed in the details of the configurations. In the present disclosure, replacement and combination of the components and the change of the order in each embodiment can be implemented without necessarily departing from the claimed scope and the spirit of the present disclosure.

The present disclosure has been fully described related to the embodiments with reference to the accompanying drawings; however, it is obvious for those skilled in the art to make various modifications and amendments. It should be understood that such modifications and amendments are included in the scope of the present disclosure based on the scope of the accompanying claims without necessarily departing from the scope of claims of the present disclosure.

INDUSTRIAL APPLICABILITY

The present disclosure can provide a dual band compatible antenna device having excellent antenna characteristics, thus is applicable to an antenna of various products in a wireless communication apparatus, and is highly versatile.

REFERENCE SIGNS LIST

1 substrate
2, 22 first branch electrode
2*a* distal end
2A, 22A first electrode portion
3, 23 second branch electrode
3*a* distal end
3A, 23A second electrode portion
4, 24 common electrode
4*a*, 24*c* branching portion (derivation end portion)
5 ground electrode
6 feed point
7 first adjustment element
8 second adjustment element
9 third adjustment element

The invention claimed is:

1. A dual band compatible antenna device comprising:

a common electrode having a feed end and a branching end, the feed end being connected to a feed node at which a signal having a low band frequency and a signal having a high band frequency are supplied, and the branching end being opposite the feed end;

a first adjustment circuit element connected to a first side of the branching end;

a second adjustment circuit element connected to a second side of the branching end, the first side being opposite the second side;

a first branch electrode connected to the common electrode via the first adjustment circuit element, the first adjustment circuit element being interposed between the first branch electrode and the common electrode; and a second branch electrode connected to the common electrode via the second adjustment circuit element, the second adjustment circuit element being interposed between the second branch electrode and the common electrode, wherein a first electrode portion of the first branch electrode and a second electrode portion of the second branch electrode extend linearly from the first and second sides of the branching end of the common electrode, wherein a line extending through the first electrode portion and the second electrode portion has a length equal to or greater than two-thirds of a total electrical length of the second branch electrode and the first branch electrode, wherein when the signal having the low band frequency is supplied from the feed node to the common electrode:

a current flowing through the first electrode portion via the first adjustment circuit element is greater than a current flowing through the second electrode portion via the second adjustment circuit element, and wherein when the signal having the high band frequency is supplied from the feed node to the common electrode:

the first adjustment circuit element has an inductive reactance, the second adjustment circuit element has a capacitive reactance, the current flowing through the first electrode portion via the first adjustment circuit element and the current flowing through the second electrode portion via the second adjustment circuit element have the same phase, and the signal having the high band frequency causes the first branch electrode and the second branch electrode to resonate as a dipole antenna.

2. The dual band compatible antenna device according to claim 1, wherein:

the total electrical length of the first branch electrode and the second branch electrode is one-half of a wave length of the high band frequency, the total electrical length being from a distal end of the first branch electrode to a distal end of the second branch electrode, the distal end of the first branch electrode being an end of a branched portion of the first branch electrode that extends along a different direction than the first electrode portion, and the distal end of the second branch electrode being an end of a branched portion of the second branch electrode that extends along a different direction than the second electrode portion.

3. The dual band compatible antenna device according to claim 1, wherein the common electrode comprises a third adjustment circuit element.

4. The dual band compatible antenna device according to claim 2, wherein the common electrode comprises a third adjustment circuit element.

5. The dual band compatible antenna device according to claim 3, wherein the third adjustment circuit element comprises an inductive reactance element, a capacitive reactance element, or both the inductive reactance element and the capacitive reactance element.

6. The dual band compatible antenna device according to claim 4, wherein the third adjustment circuit element comprises an inductive reactance element, a capacitive reactance element, or both the inductive reactance element and the capacitive reactance element.

7. The dual band compatible antenna device according to claim 1, wherein when the signal having the low band frequency is supplied from the feed node to the common electrode:

the first adjustment circuit element has the inductive reactance, and the signal having the low band frequency causes the common electrode and the first branch electrode to resonate as a monopole antenna.

8. The dual band compatible antenna device according to claim 2, wherein when the signal having the low band frequency is supplied from the feed node to the common electrode:

the first adjustment circuit element has the inductive reactance, and the signal having the low band frequency causes the common electrode and the first branch electrode to resonate as a monopole antenna.

9. The dual band compatible antenna device according to claim 3, wherein when the signal having the low band frequency is supplied from the feed node to the common electrode:

the first adjustment circuit element has the inductive reactance, and the signal having the low band frequency causes the common electrode and the first branch electrode to resonate as a monopole antenna.

10. The dual band compatible antenna device according to claim 5, wherein when the signal having the low band frequency is supplied from the feed node to the common electrode:

the first adjustment circuit element has the inductive reactance, and the signal having the low band frequency causes the common electrode and the first branch electrode to resonate as a monopole antenna.

* * * * *